US010650992B2

(12) United States Patent
Kobayashi et al.

(10) Patent No.: US 10,650,992 B2
(45) Date of Patent: May 12, 2020

(54) SWITCH DEVICE

(71) Applicant: TOYO DENSO CO., LTD., Minato-ky, Tokyo (JP)

(72) Inventors: Masahito Kobayashi, Tsurugashima (JP); Naoto Ootsuka, Tsurugashima (JP)

(73) Assignee: Toyo Denso Co., Ltd., Tokyo (JP)

( * ) Notice: Subject to any disclaimer, the term of this patent is extended or adjusted under 35 U.S.C. 154(b) by 0 days.

(21) Appl. No.: 16/153,927

(22) Filed: Oct. 8, 2018

(65) Prior Publication Data

US 2019/0108954 A1 Apr. 11, 2019

(30) Foreign Application Priority Data

Oct. 10, 2017 (JP) ..... 2017-196826

(51) Int. Cl.

| | |
|---|---|
| ***H01H 23/24*** | (2006.01) |
| ***H01H 25/04*** | (2006.01) |
| ***H01H 1/58*** | (2006.01) |
| ***H01H 23/00*** | (2006.01) |
| ***H01H 23/04*** | (2006.01) |
| ***H01H 25/06*** | (2006.01) |
| *H01H 25/00* | (2006.01) |
| *H01H 21/24* | (2006.01) |

(52) U.S. Cl.

CPC ..... *H01H 23/24* (2013.01); *H01H 1/5833* (2013.01); *H01H 23/003* (2013.01); *H01H 23/04* (2013.01); *H01H 25/04* (2013.01); *H01H 25/06* (2013.01); *H01H 21/24* (2013.01); *H01H 25/008* (2013.01)

(58) Field of Classification Search

CPC .... H01H 23/24; H01H 1/5833; H01H 23/003; H01H 23/04

USPC ..... 200/237

See application file for complete search history.

(56) References Cited

FOREIGN PATENT DOCUMENTS

| | | | | |
|---|---|---|---|---|
| JP | H07-41928 U | | 7/1995 | |
| JP | 2003045290 | * | 2/2003 | ..... H01H 25/06 |
| JP | 3993404 B2 | | 10/2007 | |

* cited by examiner

*Primary Examiner* — Edwin A. Leon
*Assistant Examiner* — Iman Malakooti
(74) *Attorney, Agent, or Firm* — Carrier Blackman & Associates, P.C.; Joseph P. Carrier; Jeffrey T. Gedeon

(57) ABSTRACT

In a switch device, an operating knob is capable of being pushed so as to swing around a first axis from a non-operated position to a predetermined push operation position with respect to a switch case and is capable of being toggled so as to swing around a second axis that is orthogonal to the first axis from the non-operated position to a predetermined toggle operation position. A first engagement portion where the operating knob engages with a push switch is disposed on the second axis, and a second engagement portion where the operating knob engages with a toggle switch is disposed at a position closer to the first axis in a direction along the second axis than the first engagement portion where the operating knob engages with the push switch.

8 Claims, 11 Drawing Sheets

SWITCH DEVICE

BACKGROUND OF THE INVENTION

Field of the Invention

The present invention relates to a switch device, and in particular to a switch device in which both a push operation and a toggle operation can be carried out with an operating knob.

Description of the Related Art

Conventionally, as a switch device in which both a pressing tilting operation (toggle operation) on the peripheral part of an operating knob and a pushing operation (push operation) on the center part of the knob can be carried out, for example, the arrangements shown in Japanese Utility Model Application Laid-open No. 7-41928 and Japanese Patent No. 3993404 are known.

In the switch device of Japanese Utility Model Application Laid-open No. 7-41928, the operating knob is dividedly formed from a peripheral knob and a center knob, thus enabling a pressing tilting operation (toggle operation) on the peripheral knob and a pushing operation (push operation) on the center knob to be carried out separately, but in this arrangement due to the operating knob being formed in a divided manner, there are the problems that the number of components increases and the structure becomes large and complicated. Furthermore, if a finger of an operator straddles both the peripheral knob and the center knob at the time of operation, there is a possibility that the switch might be erroneously operated.

Therefore, in the switch device of Japanese Utility Model Application Laid-open No. 7-41928, in order to prevent an erroneous operation, the operating stroke of a push switch corresponding to the center knob is set to be longer than the operating stroke of a toggle switch corresponding to the peripheral knob; in relation thereto it is necessary to considerably change the switch specification between the push switch and the toggle switch, and there is the problem that the management of components and the assembly workability accordingly become complicated.

On the other hand, in the switch device of Japanese Patent No. 3993404, both a pressing tilting operation (toggle operation) on the peripheral part and a pushing operation (push operation) on the center part can be carried out on a single operating knob, and in this arrangement the toggle operation is carried out, with a push switch corresponding to the knob center part as a swing fulcrum for the operating knob, by pushing the peripheral part of the operating knob and swinging the operating knob around the swing fulcrum. Because of this, depending on the extent to which the pressing force is applied to the operating knob, there is a possibility that the switch will be operated erroneously.

Therefore, in the switch device of Japanese Patent No. 3993404, in order to prevent an erroneous operation, the push switch operating resistance (operating load) corresponding to the knob center part is set sufficiently larger than the toggle switch operating resistance (operating load) corresponding to the peripheral part of the knob; in relation thereto it is necessary to considerably change the switch specification between the push switch and the toggle switch, and there is the problem that the management of components and the assembly workability accordingly become complicated.

SUMMARY OF THE INVENTION

The present invention has been accomplished in light of such circumstances, and it is an object thereof to provide a switch device that enables a push operation and a toggle operation to be carried out with a single operating knob without an erroneous operation and that enables switches having the same specification to be used in common for a push switch and a toggle switch.

In order to achieve the object, according to a first aspect of the present invention, there is provided a switch device comprising a switch case, an operating knob that is swingably mounted on the switch case, and urging devices that can urge and retain the operating knob at a predetermined non-operated position when the operating knob is not operated, the operating knob being capable of being pushed so as to swing around a first axis from the non-operated position to a predetermined push operation position with respect to the switch case and being capable of being toggled so as to swing around a second axis that is orthogonal to the first axis from the non-operated position to a predetermined toggle operation position, the switch case being provided with a push switch, as one of said urging devices, that engages with the operating knob and is switched ON or OFF when the operating knob attains the push operation position, and a toggle switch, as another of said urging devices, that engages with the operating knob and is switched ON or OFF when the operating knob attains the toggle operation position, a first engagement portion where the operating knob engages with the push switch being disposed on the second axis, and a second engagement portion where the operating knob engages with the toggle switch being disposed at a position closer to the first axis in a direction along the second axis than the first engagement portion where the operating knob engages with the push switch.

In accordance with the first aspect of the present invention, since the operating knob can be subjected to a push operation by being swung around the first axis from the non-operated position to the predetermined push operation position with respect to the switch case and also to a toggle operation by being swung around the second axis, which is orthogonal to the first axis, from the non-operated position to the predetermined toggle operation position, and the first engagement portion where the operating knob engages with the push switch is disposed on the second axis, even if the operating knob swings around the second axis at the time of the toggle operation, the swing displacement does not become an operating displacement (stroke) on the push switch, and there is no possibility that the push switch will be turned ON by the operating knob. Moreover, since the second engagement portion where the operating knob engages with the toggle switch is disposed at a position closer to the first axis in a direction along the second axis than the first engagement portion where the operating knob engages with the push switch, due to there being a difference in the distance from the first axis between the two engagement portions, even if the operating knob swings around the first axis at the time of a push operation, there is no possibility that the toggle switch will be turned ON by the operating knob.

As a result, both the toggle operation and the push operation can be carried out appropriately with the single operating knob without erroneous operation, it is not necessary to greatly change the specifications of the push switch and the toggle switch in order to prevent erroneous operation, and it is advantageous in terms of simplification of the management of components and the assembly workability.

Moreover, since the operating knob for the toggle operation and the push operation is a single component, the number of components of the switch device can be cut, the structure can consequently be made small and simplified, and it can be disposed in a confined space without problems.

According to a second aspect of the present invention, in addition to the first aspect, a stopper device is provided between the switch case and the operating knob, the stopper device restricting swing displacement of the operating knob when both the toggle operation and the push operation are erroneously carried out for the operating knob, so that only either one of the operations can be carried out from halfway through the operation.

In accordance with the second aspect of the present invention, since the stopper device restricts swing displacement of the operating knob when both a toggle operation and a push operation are erroneously carried out on the operating knob so that only either one of the operations can be carried out from halfway through the operation, it becomes possible to prevent more effectively erroneous operation of the switch even when both a toggle operation and a push operation are erroneously carried out.

According to a third aspect of the present invention, in addition to the first or second aspect, a main shaft part extending on the second axis is provided on one of opposite side parts of the operating knob, the main shaft part is provided with a spherical surface portion having an intersection point of the first and second axes as a center, the switch case is provided with a spherical surface support portion that relatively slidably abuts against the spherical surface portion to allow pivoting of the spherical surface portion around each of the first and second axes, and a main shaft part guide device is provided between the main shaft part and the switch case, the main shaft part guide device guiding pivoting of the main shaft part around each of the first and second axes while fixing the intersection point to a fixed position within the switch case in cooperation with the spherical surface support portion.

In accordance with the third aspect of the present invention, since the main shaft part extending on the second axis is provided on the one side part of the operating knob, the main shaft part is provided with the spherical surface portion having the intersection point of the first and second axes as a center, the switch case is provided with the spherical surface support portion, which relatively slidably abuts against the spherical surface portion to allow pivoting of the spherical surface portion around each of the first and second axes, and the main shaft part guide device is provided between the main shaft part and the switch case, the main shaft part guide device guiding pivoting of the main shaft part around each of the first and second axes while fixing the intersection point to a fixed position within the switch case in cooperation with the spherical surface support portion, it is possible to integrate the main shaft part with the operating knob. This enables the swing support structure of the operating knob, which can swing around each of the first and second axes with respect to the switch case, to be simplified, thus contributing to a reduction in the cost.

According to a fourth aspect of the present invention, in addition to the third aspect, a countershaft part extending on the second axis is provided on an other of the opposite side parts of the operating knob, and a countershaft part guide device is provided between the countershaft part and the switch case, the countershaft part guide device guiding pivoting of the countershaft part around the first axis while allowing pivoting around the second axis.

In accordance with the fourth aspect of the present invention, since the countershaft part extending on the second axis is provided on the other side part of the operating knob, and the countershaft part guide device is provided between the countershaft part and the switch case, the countershaft part guide device guiding pivoting of the countershaft part around the first axis while allowing pivoting around the second axis, even if the operating knob is cantilever-supported on the switch case via the one side part (that is, the main shaft part) side, pivoting around the first axis of the free end part (the other side part) side of the operating knob can be stably and appropriately guided by the countershaft part guide device. The burden on the main shaft part and the cantilever-support part of the switch case supporting the operating knob can thereby be lightened, thereby contributing to improving the durability of the device.

According to a fifth aspect of the present invention, in addition to the first aspect, the urging devices comprise a first urging device that can urge and retain the operating knob at the non-operated position in a swing direction around the first axis and a second urging device that can urge and retain the operating knob at the non-operated position in a swing direction around the second axis, the push switch serving also as the first urging device, and the toggle switch serving also as the second urging device.

In accordance with the fifth aspect of the present invention, since the push switch serves also as the first urging device, which can urge and retain the operating knob at the non-operated position in the swing direction around the first axis, and the toggle switch serves also as the second urging device, which can urge and retain the operating knob at the non-operated position in the swing direction around the second axis, it becomes unnecessary to specially provide first and second urging devices for exclusive use, and the structure can be made still smaller and simpler.

According to a sixth aspect of the present invention, in addition to the first aspect, the operating knob can be subjected to a toggle operation in two directions that are opposite to each other by swinging around the second axis between the non-operated position and the first toggle operation position and between the non-operated position and the second toggle operation position, and the toggle switch comprises a first toggle switch that is provided on one of opposite sides of the switch case with respect to the second axis and that engages with the operating knob and switches to ON or OFF when the operating knob attains the first toggle operation position, and a second toggle switch that is provided on an other of the opposite sides of the switch case with respect to the second axis and that engages with the operating knob and switches to ON or OFF when the operating knob attains the second toggle operation position.

In accordance with the sixth aspect of the present invention, since the operating knob can be subjected to a toggle operation in two directions that are opposite to each other by swinging around the second axis between the non-operated position and the first toggle operation position and between the non-operated position and the second toggle operation position, the first toggle switch, which engages with the operating knob when the operating knob attains the first toggle operation position and switches between ON and OFF, is provided on the one side of the switch case with respect to the second axis, and the second toggle switch, which engages with the operating knob when the operating knob attains the second toggle operation position and switches between ON and OFF, is provided on the other side of the switch case with respect to the second axis, it is possible to easily obtain a switch device in which not only a push operation but also toggle operations in two mutually opposite directions from the non-operated position can be carried out even when the operating knob is a single unit.

The above and other objects, characteristics and advantages of the present invention will be clear from detailed descriptions of the preferred embodiment which will be provided below while referring to the attached drawings.

DESCRIPTION OF THE PREFERRED EMBODIMENT

An embodiment of the present invention is explained below by reference to the attached drawings.

Figure 1:
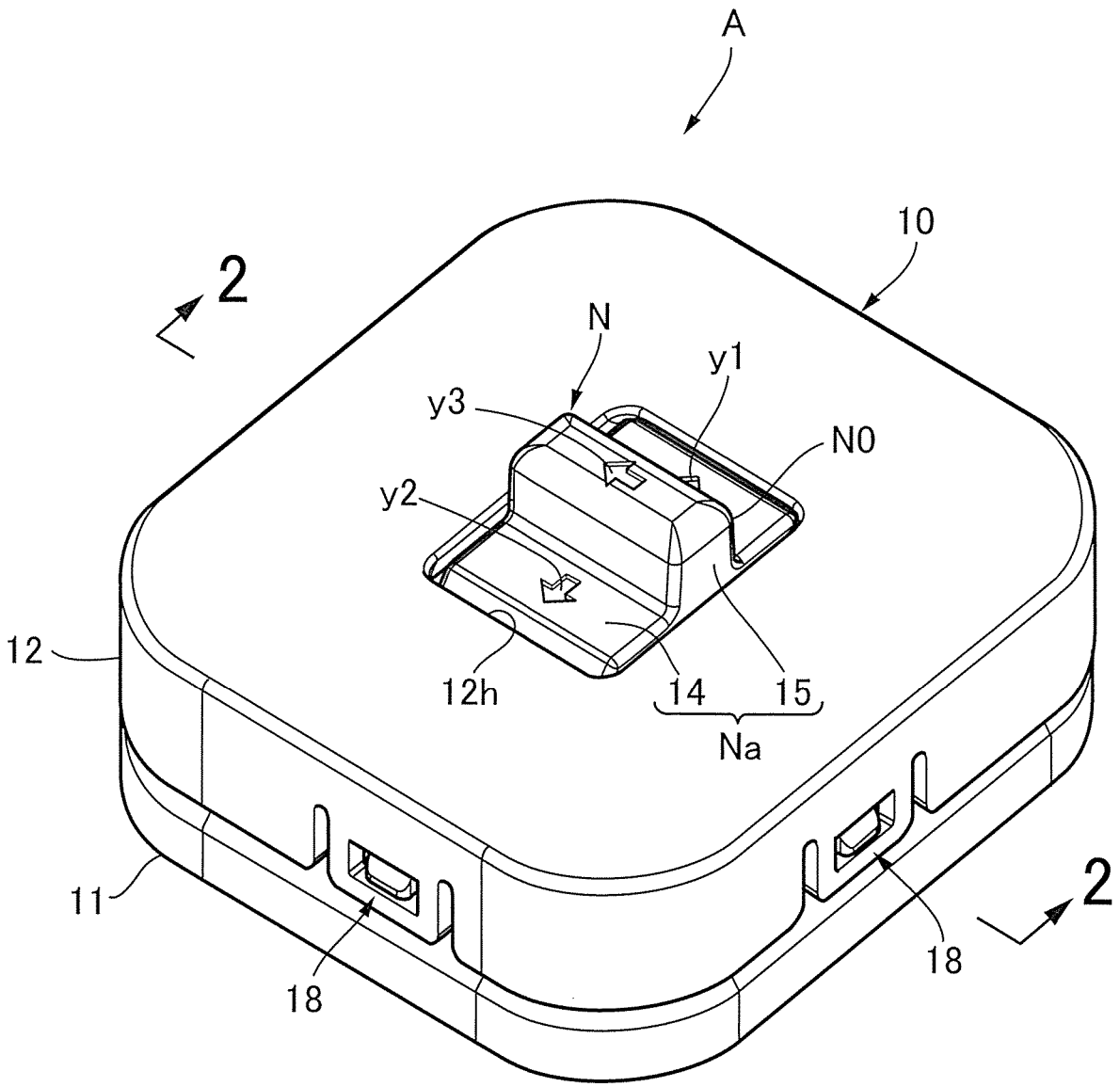
FIG. 1 is an overall perspective view of a switch device related to one embodiment of the present invention.
Figure 6:
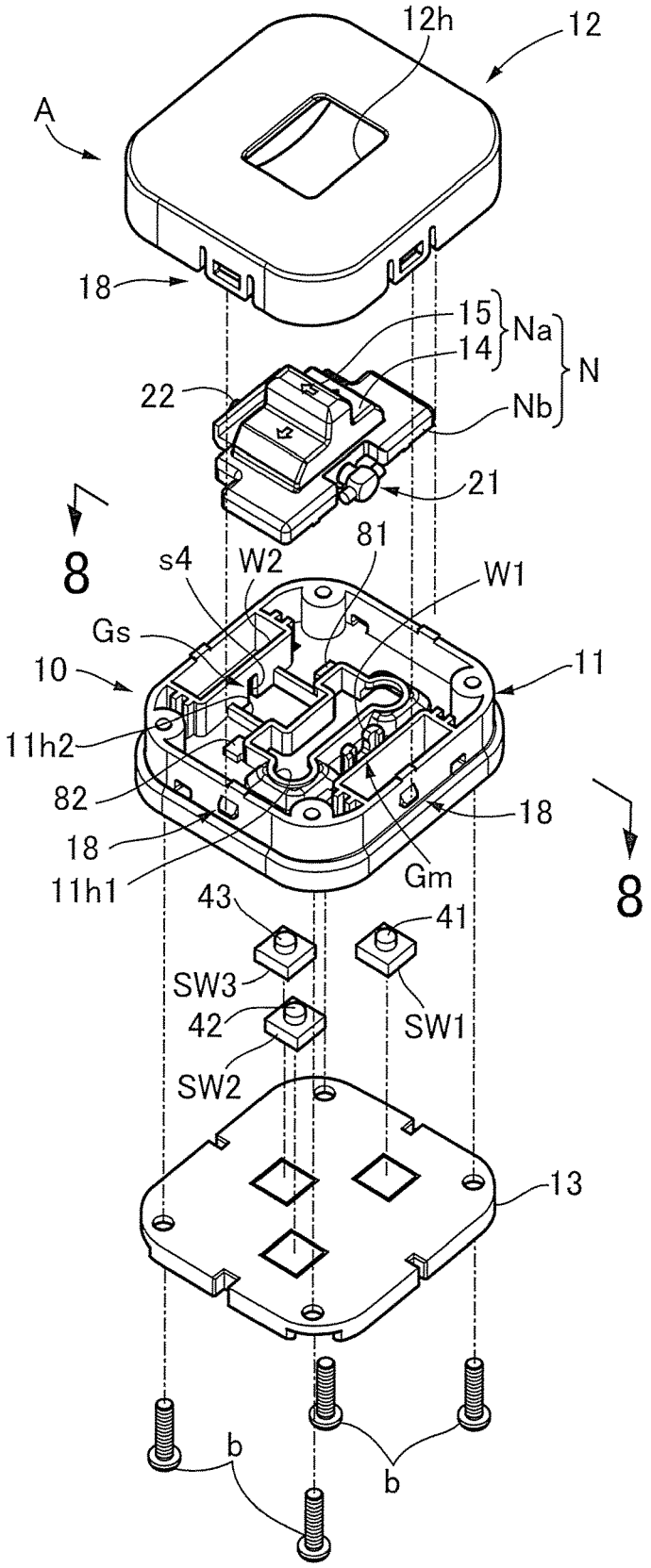
FIG. 6 is an exploded perspective view of the switch device.

In FIG. 1 and FIG. 6, a switch device A related to the present invention is placed and fixed to an appropriate position within an automobile compartment, for example an instrument panel (not illustrated), so that it can be finger operated by a driver. The switch device A has a switch case 10, first and second toggle switches SW1 and SW2 (as a toggle switch, second urging means, and urging means) and a push switch SW3 (as first urging means, and urging means) that are installed within the switch case 10, a single operating knob N that is swingably mounted on the switch case 10 and can operate the switches SW1 to SW3, and urging means (in the present embodiment the switches SW1 to SW3 serving also as said urging means) that can usually (that is, when not being operated) urge and retain the operating knob N at a predetermined non-operated position N0. The switch case 10 is detachably mounted on the instrument panel by appropriate mounting means, which is not illustrated.

Referring in addition to FIG. 2 to FIG. 5, the switch device A includes a push switch function of pushing in the operating knob N from the non-operated position N0 toward the deeper side with an operator as a reference, that is, toward a push operation position N3 that is described later (that is, a push operation) to switch the push switch SW3 ON, and a toggle switch function of pressing and tilting the operating knob N from the non-operated position NO toward first or second toggle operation position N1 or N2 (as a toggle operation position) that are described later (that is, a first or second toggle operation) to switch the first or second toggle switch SW1 or SW2 ON.

That is, in the switch device A the single operating knob N can be pushed from the non-operated position N0 (the solid line position in FIG. 2) to the predetermined push operation position N3 (the double-dotted broken line position in FIG. 2) so as to swing around a first axis L1 with respect to the switch case 10 and the operating knob N can be toggled in two directions (for example, upward and downward or leftward and rightward from the viewpoint of the operator) from the non-operated position N0 (the solid line position in FIG. 4) to the predetermined first toggle operation position N1 (the double-dotted broken line position in FIG. 4) or the second toggle operation position N2 (not illustrated), which is on the opposite side, so as to swing around a second axis L2 that is orthogonal to the first axis L1.

The operating knob N is mounted on the switch case 10 so as to be swingable around either of the first and second axes L1 and L2, which each extend along an operating face (an upper face of a case lid 12, which is described later) of the switch case 10 and bisect each other at right angles at a fixed point (intersection point O) within the switch case 10. The mounting structure therefor is described in detail later.

Each of the switches SW1 to SW3 of the switch device A can be freely employed for operation of various types of electronic instruments related to a driving operation of an automobile. For example, when they are used in relation to an air conditioner operation, they can be used so that the air conditioner starts when the push switch SW3 is turned ON and when the first or second toggle switch SW1 or SW2 is turned ON the amount of air of the blower of the air conditioner is increased or decreased.

In the present embodiment, the switch case 10 includes a flattened angular tubular case main body 11 having an open upper face, a case lid 12 that is disengageably latched on a peripheral wall portion 11*w* of the case main body 11 and covers the open upper face of the case main body 11, and a case board 13 that is detachably joined to a lower face of the case main body 11 by a plurality of securing means (e.g. a bolt b).

The case board 13 also functions as an electronic board, and switch bodies 31 and 32 of the first and second toggle switches SW1 and SW2 and a switch body 33 of the push switch SW3 are fixed to an upper face of the case board 13. The switch bodies 31 to 33 are connected to an electronic circuit within the case board 13.

On the other hand, toggle switch pressing projections 61 and 62 are projectingly provided at positions corresponding to the first and second toggle switches SW1 and SW2 respectively of a lower face of the operating knob N, and a push switch pressing projection 63 is projectingly provided at a position corresponding to the push switch SW3. The switch pressing projections 61 to 63 can turn the corresponding switches SW1 to SW3 ON through a plurality of through holes 11*h*1 and 11*h*2 formed in the case main body 11.

As the first and second toggle switches SW1 and SW2 and the push switch SW3, a microswitch is used in the present embodiment. As for a conventionally known microswitch, the switches SW1 to SW3 each include the switch bodies 31 to 33 containing a contact mechanism (not illustrated) that opens and closes with a defined movement and a defined spring load, and operating elements (e.g. piston-shaped push-buttons) 41 to 43 supported on the switch bodies 31 to 33 so that they can slide between a predetermined protruding position and a predetermined switch pushed-in position (that is, a switch ON position).

In the present embodiment, each of the contact mechanisms is usually retained in an OFF state by virtue of the resilient force of a return spring possessed by the contact mechanism. Furthermore, each of the operating elements 41 to 43 is retained at the protruding position by virtue of the resilient force of the return spring in a free state in which they do not receive an operating force from the operating knob N (that is, the switch pressing projections 61 to 63).

In FIG. 2 to FIG. 5, the solid line (the solid line and the dotted line in FIG. 3) shows a state in which the operating knob N is at the non-operated position N0 and each of the operating elements 41 to 43 is either at the protruding position or at a position slightly below the protruding position, and in this arrangement each of the switches SW1 to SW3 is in an OFF state.

Figure 2:
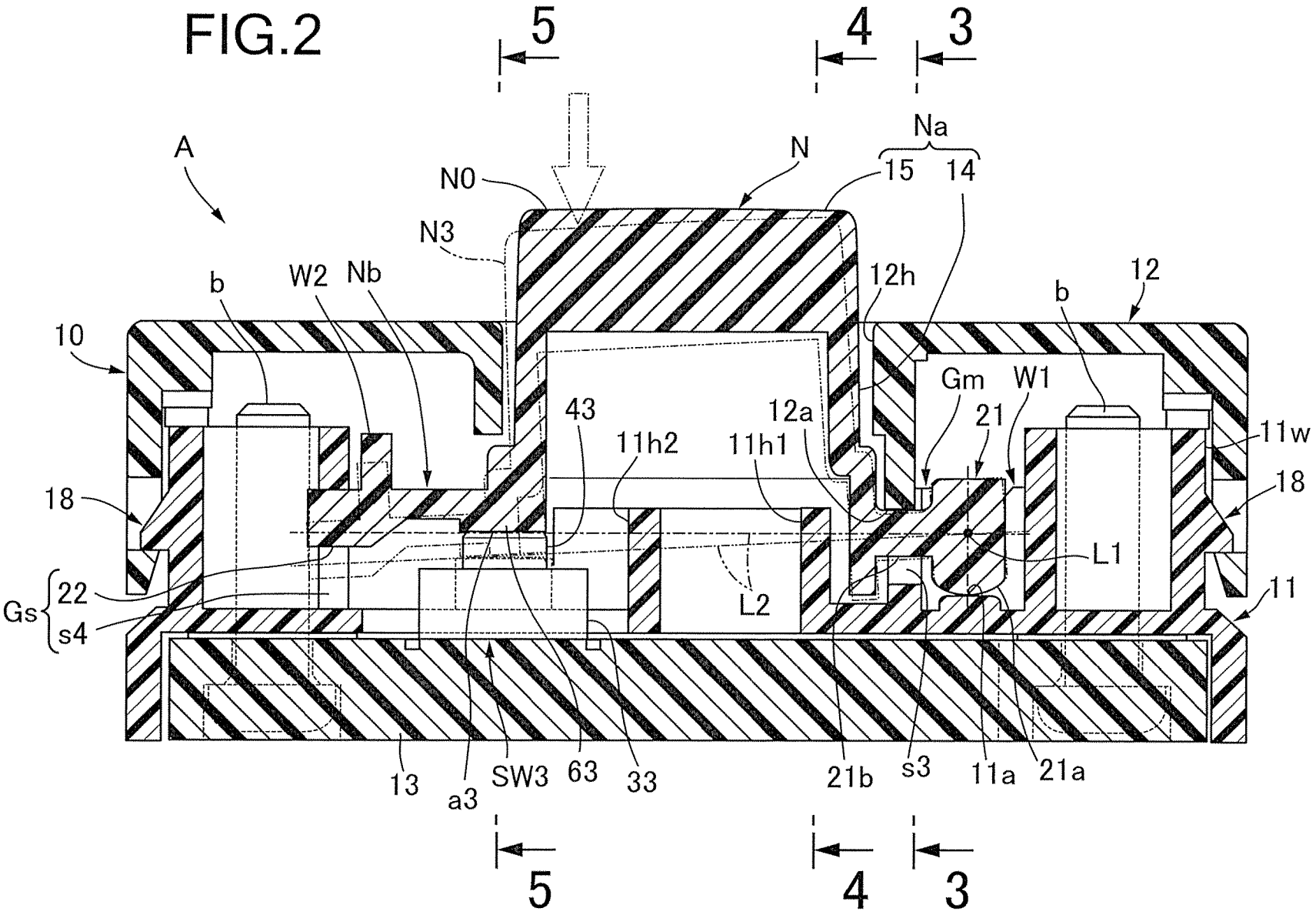
FIG. 2 is an enlarged sectional view along line 2-2 in FIG. 1.
Figure 3:
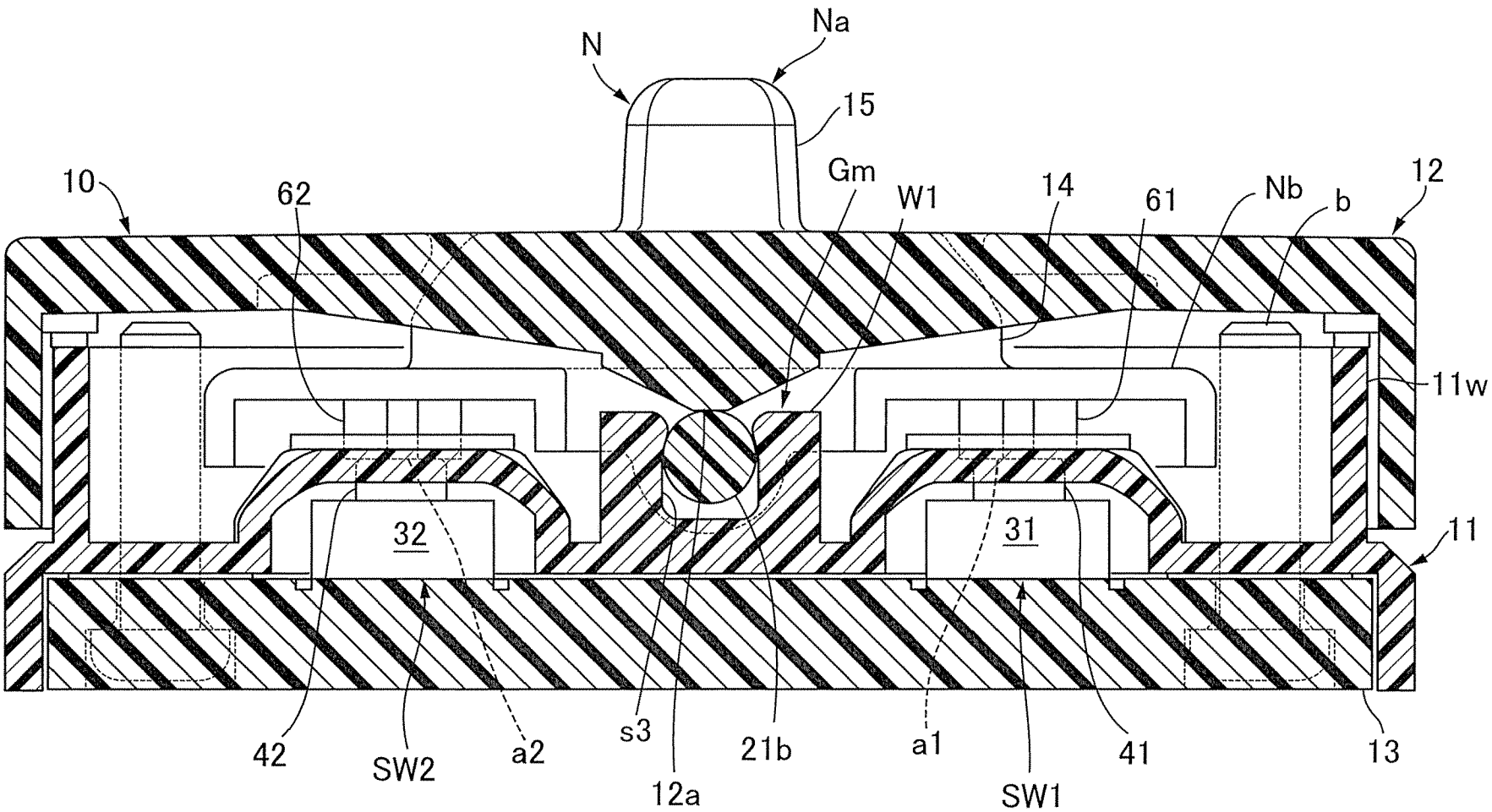
FIG. 3 is a sectional view along line 3-3 in FIG. 2.

Furthermore, in FIG. 2 the double-dotted broken line shows a state in which the operating knob N is at the push operation position N3 and the operating element 43 of the push switch S3 is pushed in to the switch pushed-in position.

Figure 4:
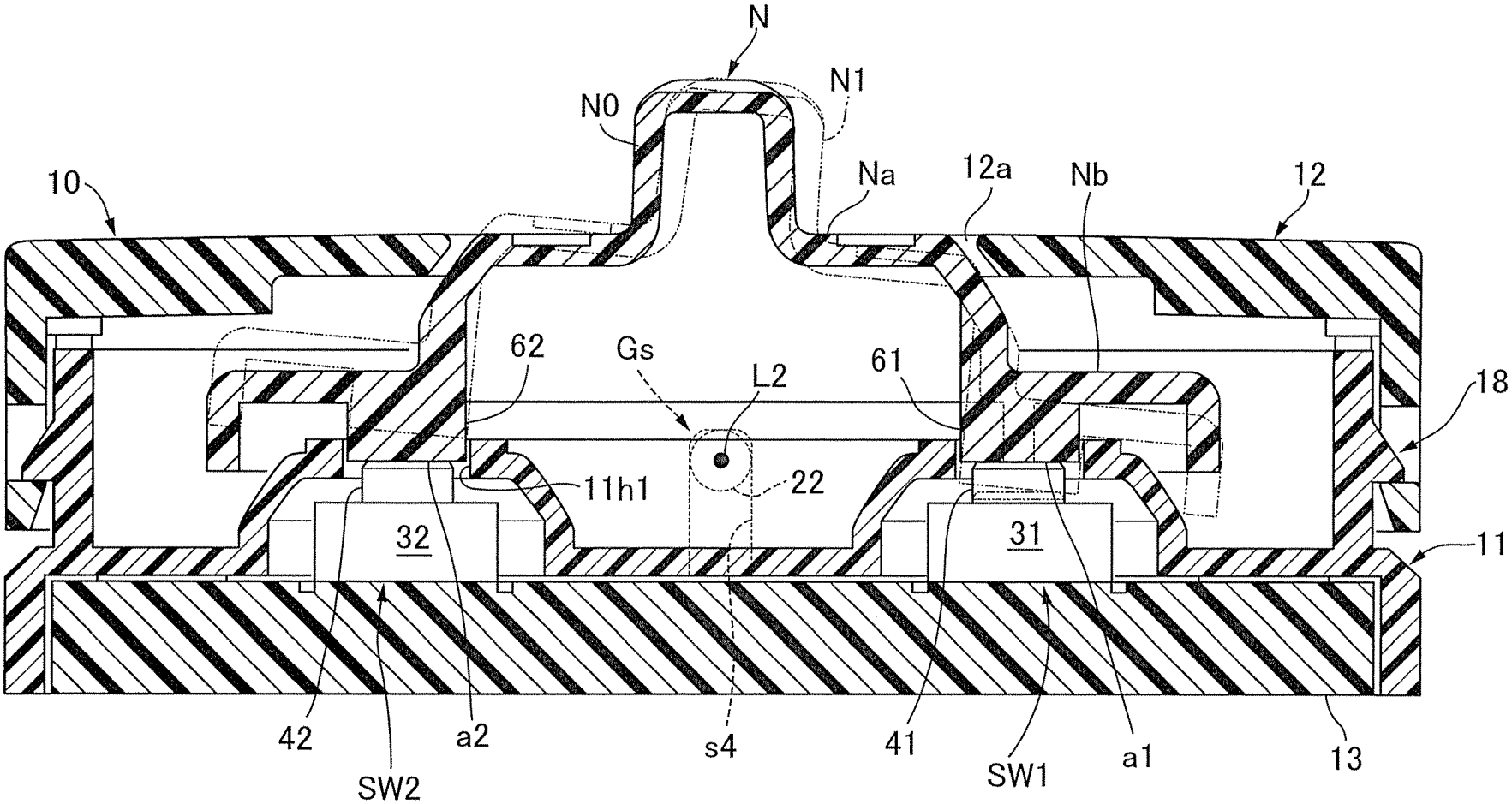
FIG. 4 is a sectional view along line 4-4 in FIG. 2.

Moreover, in FIG. 4 the double-dotted broken line shows a state in which the operating knob N is at the first toggle operation position N1 and the operating element 41 of the first toggle switch S1 is pushed into the switch pushed-in position. In FIG. 4, a state in which the operating knob N is at the second toggle operation position N2 is not illustrated, but this state has a line-symmetric positional relationship with respect to a vertical line passing through the second axis L2 as an axis of symmetry, with the state of the operating knob N shown by the double-dotted broken line in FIG. 4.

When the operating knob N is subjected to the first or second toggle operation or the push operation, the operating elements 41 to 43 engage with the switch pressing projections 61 to 63 corresponding to the operation and are pushed in to the switch pushed-in position in operative connection therewith, thereby enabling the contact mechanism corresponding to the operation to be turned ON.

Provided in the case lid 12 is a rectangular opening 12*h* through which a knob main body Na of the operating knob N is exposed. The case lid 12 and the case main body 11 are disengageably latched and fixed to each other by resilient latching means 18 provided therebetween. The case lid 12 may be detachably secured to the case main body 11 by other fixing means (e.g. a bolt).

Figure 7:
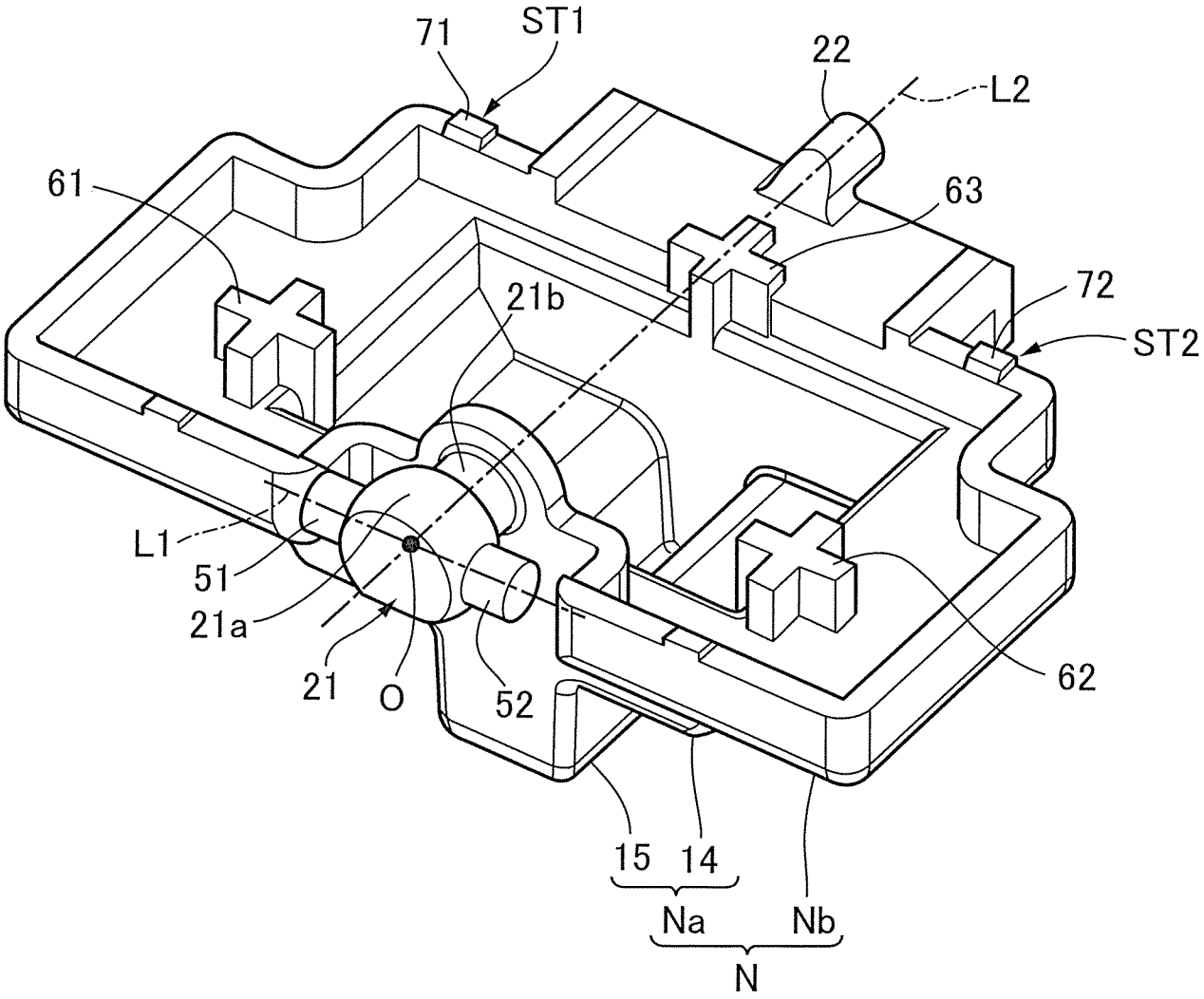
FIG. 7 is a perspective view of an operating knob on its own when viewed obliquely from the back face side.
Figure 8:
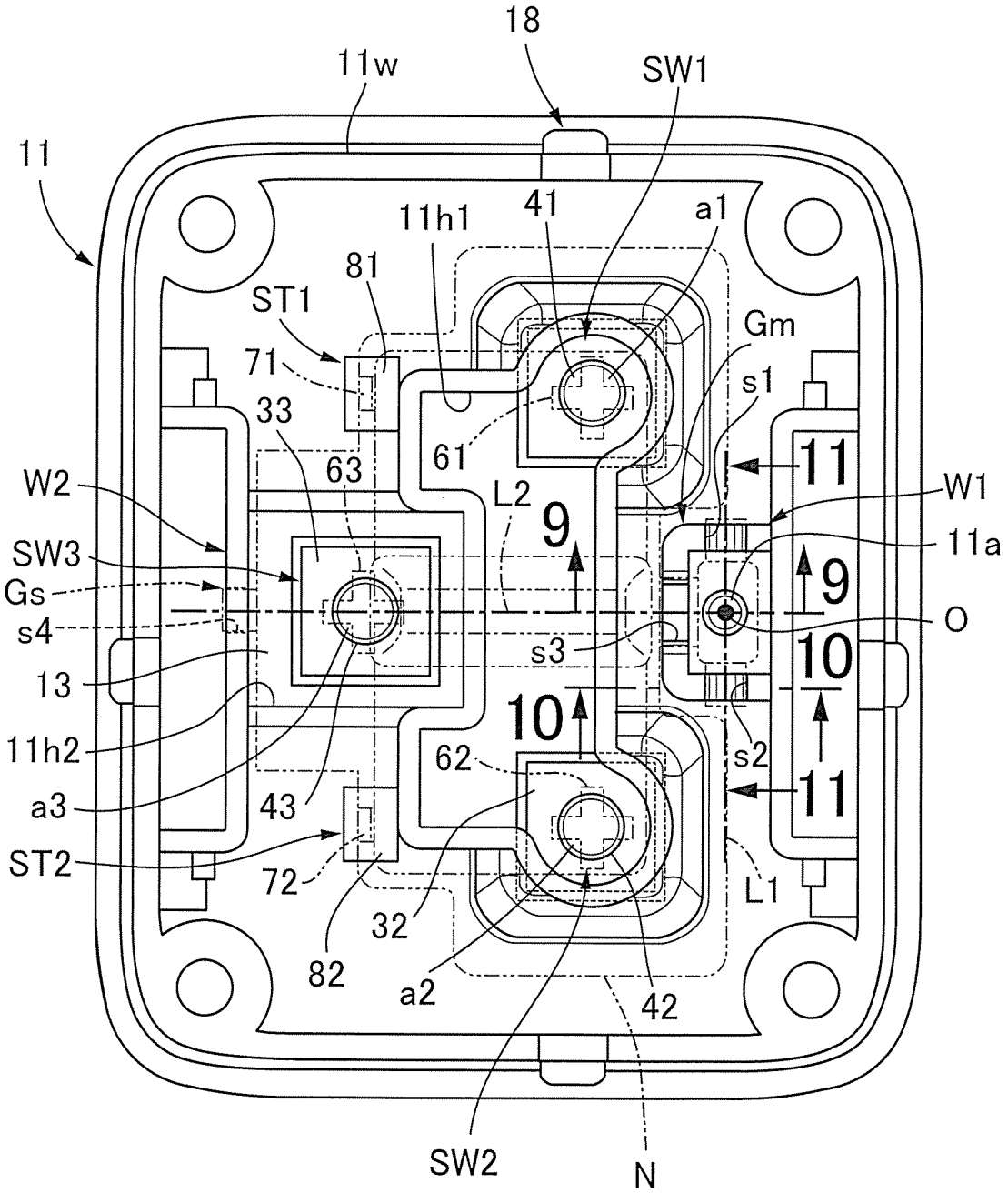
FIG. 8 is a plan view of a switch device case main body on its own (view from arrowed line 8-8 in FIG. 6).
Figure 9:
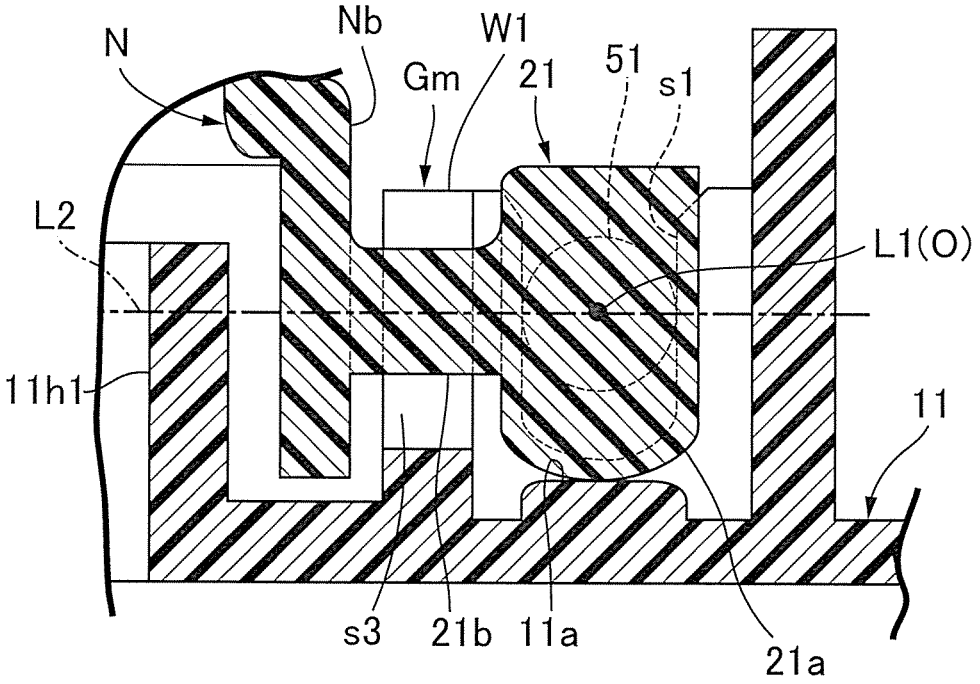
FIG. 9 is an enlarged sectional view along line 9-9 in FIG. 8.
Figure 10:
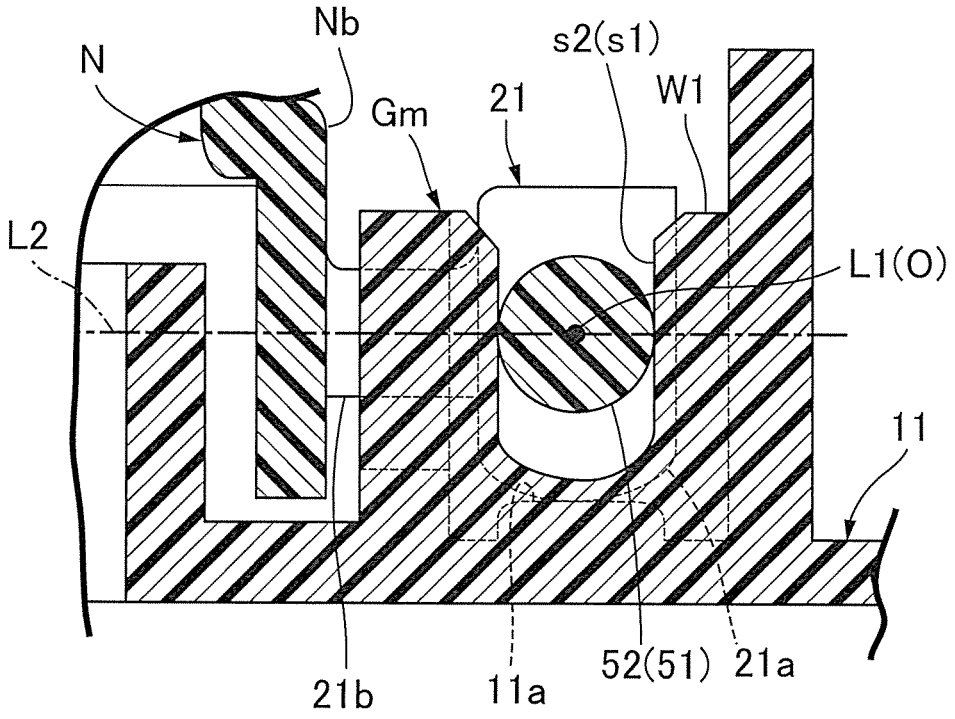
FIG. 10 is an enlarged sectional view along line 10-10 in FIG. 8.
Figure 11:
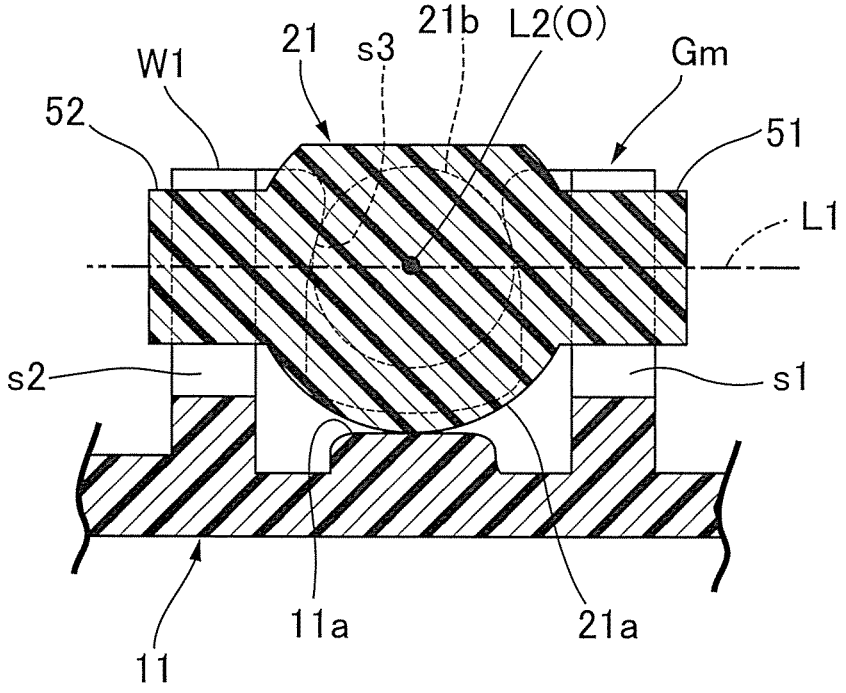
FIG. 11 is an enlarged sectional view along line 11-11 in FIG. 8.

Referring in addition to FIG. 7, the operating knob N includes the knob main body Na and a knob base Nb that is connectedly provided integrally with a lower face of the knob main body Na and is formed so as to be wider than the knob main body Na, the knob base Nb being housed within the switch case 10 immediately beneath the case lid 12. The knob main body Na has a substantially rectangular parallelepiped flat knob main body base part 14 corresponding to the opening 12*h* of the case lid 12, and a knob main body extremity 15 standingly provided on a central part of an upper face of the knob main body base part 14.

The knob main body extremity 15 functions as an operating lever for a first or second toggle operation (that is, swinging the operating knob N around the second axis L2), and in the present embodiment it is formed into a lengthwise lever shape extending along the second axis L2. The knob main body extremity 15 functions also as a push button for a push operation for an apex part thereof (that is, pushing and swinging the operating knob N around the first axis L1), and in this case the push operation can be efficiently and lightly carried out by pushing the apex part of the knob main body extremity 15, in particular the end part furthest from the first axis L1 or the vicinity thereof.

A display part such as a picture showing an operating direction for the operating knob N is appropriately added to an outer surface of the knob main body Na as required. For example, in the present embodiment arrows y1 and y2 displaying the two toggle operation directions are marked on the outer surface of the knob main body base part 14 and an arrow y3 displaying the push operation direction is marked on the outer surface of the knob main body extremity 15. Instead of or in addition to the arrows y1 to y3, characters or symbols suggesting the toggle operation direction or the push operation direction may be drawn. These display parts may be omitted.

One example of the mounting structure for mounting the operating knob N on the switch case 10 so that it can swing around the first and second axes L1 and L2 is now explained by reference in addition to FIG. 8 to FIG. 11.

A main shaft part 21 extending on the second axis L2 is formed integrally with one side part, in a direction along the second axis L2, of the operating knob N (specifically, the knob base Nb), and similarly a countershaft part 22 extending to the side opposite to the main shaft part 21 on the second axis L2 is formed integrally with the other side part of the operating knob N.

A spherical surface portion 21*a* is provided on an outer peripheral face of the extremity of the main shaft part 21, an outer peripheral face of a lower half of the spherical surface portion 21*a* being formed with a spherical surface having as a center the intersection point O of the first and second axes L1 and L2. A flat support face 11*a* (as a spherical surface support portion) is provided on an upper face of the switch case 10 (case main body 11) so as to correspond to the spherical surface portion 21*a*, the support face 11*a* relatively slidably abutting against the spherical surface portion 21*a* so as to allow pivoting of the spherical surface portion 21*a* around the first and second axes L1 and L2, and the support face 11*a* forming a spherical surface support portion of the present invention.

First and second short shaft parts 51 and 52 extending in directions opposite to each other on the first axis L1 are projectingly provided integrally with side faces, on one side and on the other side with respect to the second axis L2, of the spherical surface portion 21*a*. A base part of the main shaft part 21 is formed as a base shaft 21*b* extending on the second axis L2 and having a smaller diameter than that of the spherical surface portion 21*a*, and the spherical surface portion 21*a* is cantilever-supported on the knob base Nb via the base shaft 21*b*.

A first guide wall W1 having a squared U-shaped plan section is projectingly provided on an upper face of the case main body 11 at a position corresponding to the main shaft part 21. First and second slits s1 and s2 are formed in mutually opposing side wall parts respectively of the first guide wall W1, the first and second slits s1 and s2 having an open upper end and sandwiching the outer peripheral faces of the first and second short shaft parts 51 and 52 in a direction along the second axis L2 so that they can slide. On the other hand, a third slit s3 is formed in an intermediate wall part of the first guide wall W1, the third slit s3 having an open upper end and sandwiching an outer peripheral face of the base shaft 21*b* in a direction along the first axis L1 so that it can slide.

In this way, due to the first and second slits s1 and s2 respectively sandwiching the outer peripheral faces of the first and second short shaft parts 51 and 52 in the direction along the second axis L2 so that they can slide, the spherical surface portion 21*a* has its center position fixed in the direction along the second axis L2 and is guided so that it pivots around the second axis L2. Due to the third slit s3 sandwiching the outer peripheral face of the base shaft 21*b* in a direction along the first axis L1, the spherical surface portion 21*a* has its center position fixed in the direction along the first axis L1 and is guided so that it pivots around the first axis L1.

A stopper projection 12*a* is projectingly provided on a lower face of the case lid 12, the stopper projection 12*a* engaging with an upper part of an outer peripheral face of the base shaft 21*b*. The stopper projection 12*a* can directly prevent the base shaft 21*b* from coming off upward from the third slit s3 and, moreover, can prevent the spherical surface portion 21*a* from lifting from a support face 11*a*. Therefore, the center of the spherical surface portion 21*a* on the support face 11*a* is maintained at a fixed height.

In this way, the center of the spherical surface portion 21*a* (that is, the intersection point O of the first and second axes L1 and L2) becomes a fixed point fixed at a fixed position within the switch case 10, and the spherical surface portion 21*a* (and consequently the operating knob N) can pivot (swing) around either of the first and second axes L1 and L2.

In the present embodiment, at least portions close to the upper end opening of the mutually opposing inside faces of the third slit s3 are formed into inclined faces that gradually narrow in going toward the upper end opening (non-parallel faces). This enables the base shaft 21*b* to be provisionally retained by the third slit s3 even if the case lid 12 is not yet fitted to the case main body 11 in a state in which the base shaft 21*b* is pushed in from above and held by the third slit s3. In addition, the whole of the mutually opposing inside faces of the third slit s3 may be formed into parallel faces without forming the inclined faces.

The outer peripheral faces of the base shaft 21*b* and first and second short shaft parts 51 and 52, the first to third slits s1 to s3, and the stopper projection 12*a* thus form main shaft part guide means Gm of the present invention. The main shaft part guide means Gm guides pivoting of the main shaft part 21 around each of the first and second axes L1 and L2 while, in cooperation with the support face 11*a*, fixing the intersection point O of the first and second axes L1 and L2 to a fixed position within the switch case 10.

Furthermore, a second guide wall W2 extending in a direction along the first axis L1 is projectingly provided on the upper face of the case main body 11 at a position corresponding to the countershaft part 22. A fourth slit s4 having a blocked upper end is formed in the second guide wall W2, the fourth slit s4 sandwiching an outer peripheral face of the countershaft part 22 in a direction along the first axis L1 so that it can slide. When the operating knob N is at the non-operated position N0, an upper part of the outer peripheral face of the countershaft part 22 engages with the blocked upper end part of the fourth slit s4 to thus define the upper swing limit (upper limit position) around the first axis L1 of the operating knob N. Therefore, the operating knob N does not swing around the first axis L1 further upward than the non-operated position N0.

In this way, the outer peripheral face of the countershaft part 22 and the fourth slit s4 form in cooperation with each other countershaft part guide means Gs of the present invention, and this countershaft part guide means Gs guides swinging of the countershaft part 22 around the first axis L1 while allowing pivoting around the second axis L2. The fourth slit s4 of the present embodiment is used also as stopper means defining the upper swing limit (non-operated position N0) around the first axis L1 of the operating knob N (countershaft part 22), thereby accordingly simplifying the structure of the switch device A.

Moreover, urging means that can urge and retain the operating knob N so that it is usually at the non-operated position N0 is provided between the operating knob N and the switch case 10. This urging means is formed from first urging means that can urge and retain the operating knob N at the non-operated position N0 in a swing direction around the first axis L1, and second urging means that can urge and retain the operating knob N at the non-operated position N0 in a swing direction around the second axis L2.

In the present embodiment in particular, the push switch SW3 serves also as the first urging means. That is, the operating knob N can be urged and retained at the non-operated position N0 in the swing direction around the first axis L1 by virtue of the resilient force of the return spring (not illustrated) of the contact mechanism installed within the switch body 33 of the push switch SW3. In the present invention, a spring member that is exclusively used and is separate and independent from the push switch SW3 may be disposed between the operating knob N and the switch case 10 as the first urging means, and the operating knob N may be urged and retained at the non-operated position N0 in the swing direction around the first axis L1 by virtue of the resilient force of the spring member.

Moreover, in the present embodiment in particular, the first and second toggle switches SW1 and SW2 serve also as the second urging means. That is, the operating knob N can be urged and retained at the non-operated position N0 in the swing direction around the second axis L2 by virtue of the resilient force of the return spring (not illustrated) of the contact mechanism installed within the switch bodies 31 and 32 of the first and second toggle switches SW1 and SW2. In the present invention, a spring member that is exclusively used and is separate and independent from the first and second toggle switches SW1 and SW2 may be disposed between the operating knob N and the switch case 10 as the second urging means, and the operating knob N may be urged and retained at the non-operated position N0 in the swing direction around the second axis L2 by virtue of the resilient force of the spring member.

In this way, the operating knob N is mounted on the switch case 10 so that it can also swing and be displaced around either of the first and second axes L1 and L2, which bisect each other at right angles at a fixed point (intersection point O) within the switch case 10. In the mounted state, an engagement portion a3 where the operating knob N engages with the push switch SW3 at the time of a push operation (that is, an engagement portion where the push switch pressing projection 63 engages with the operating element 43 of the push switch SW3) is disposed at a position sufficiently spaced from the first axis L1 on the second axis L2.

On the other hand, engagement portions a1 and a2 where the operating knob N engages with the first and second toggle switches SW1 and SW2 at the first and second toggle operations (that is, engagement portions where the toggle switch pressing projections 61 and 62 engage with the operating elements 41 and 42 of the first and second toggle switches SW1 and SW2) are disposed at positions spaced on opposite sides of the second axis L2 in the direction along the first axis L1 and closer to the first axis L1 in the direction along the second axis L2 than the engagement portion a3 where the operating knob N engages with the push switch SW3.

Moreover, first and second stopper means ST1 and ST2 are provided between the switch case 10 and the operating knob N, the first and second stopper means ST1 and ST2 restricting swing displacement of the operating knob N when both the first or second toggle operation and the push operation are erroneously carried out on the operating knob N, so that only either one of the operations can be carried out from halfway through the operation.

In the present embodiment, the first stopper means ST1 includes a first projection 71 downwardly projectingly provided at a portion of the lower face of the knob base Nb where the downward displacement is substantially the maximum when both the first toggle operation and the push operation are erroneously carried out on the operating knob N (that is, the vicinity of an intersection point between a virtual straight line passing through the toggle switch pressing projection 61 and parallel with the second axis L2 and a virtual straight line passing through the push switch pressing projection 63 and parallel with the first axis L1 in plan view (e.g. FIG. 8)), and a first fulcrum projection 81 projectingly provided on the upper face of the case main body 11 so as to engage with the first projection 71 halfway through the operation.

In the present embodiment, the second stopper means ST2 includes a second projection 72 downwardly projectingly provided at a portion of the lower face of the knob base Nb where the downward displacement is substantially the maximum when both the second toggle operation and the push operation are erroneously carried out on the operating knob N (that is, the vicinity of an intersection point between a virtual straight line passing through the toggle switch pressing projection 62 and parallel with the second axis L2 and a virtual straight line passing through the push switch pressing projection 63 and parallel with the first axis L1 in a plan view (e.g. FIG. 8)), and a second fulcrum projection 82 projectingly provided on the upper face of the case main body 11 so as to engage with the second projection 72 halfway through the operation.

The operation of the embodiment is now explained.

When assembling the switch device A, the case board 13 having the first and second toggle switches SW1 and SW2 and the push switch SW3 fitted to the upper face thereof in advance and the case main body 11 covering the top of the case board 13 are joined by means of the bolt b, subsequently the operating knob N is mounted on the case main body 11 with the mounting structure described above, furthermore, the case lid 12 covering the operating knob N and the upper face of the case main body 11 is latched and fixed to the case main body 11 by the resilient latching means 18.

In particular, when mounting the operating knob N on the case main body 11, the countershaft part 22 of the operating knob N is inserted into the fourth slit s4 of the second guide wall W2 of the case main body 11, the base shaft 21*b* of the operating knob N is pushed and fitted into the third slit s3 of the first guide wall W1 from above and, furthermore, the first and second short shaft parts 51 and 52 are fitted into the first and second slits s1 and s2 of the first guide wall W1 from above. In this case, in relation to the mutually opposing inside faces of the third slit s3 being formed into inclined faces that gradually narrow in going toward the upper end opening as described above, even if the case lid 12 is not yet fitted to the case main body 11 the base shaft 21*b* can be provisionally secured to the third slit s3. Therefore, prior to the case lid 12 being mounted on the case main body 11, the operating knob N is provisionally assembled on the case main body 11, which can be handled as a sub-assembly, thereby achieving good assembly workability.

In a state in which the case lid 12 is mounted on the case main body 11, the stopper projection 12*a* on the lower face of the operating knob N engages with the upper part of the outer peripheral face of the base shaft 21*b*, thus reliably preventing the base shaft 21*b* from coming off upward from the third slit s3 and suppressing lifting of the spherical surface portion 21*a* from the support face 11*a* (upward displacement).

In this way, the assembly operation of the switch case 10 and the operation of mounting the operating knob N on the switch case 10 are completed, that is, the assembly operation of the switch device A is completed.

After the operating knob N is mounted on the case main body 11 (that is, the case main body 11 and the operating knob N are made into a sub-assembly), the case board 12 may be joined to the case main body 11.

In a state in which assembly of the switch device A is completed, the operating knob N can swing and be displaced with respect to the switch case 10 around either of the first and second axes L1 and L2, which bisect each other at right angles at the fixed point (intersection point O) within the switch case 10.

Moreover, when the operating knob N is not being operated, by virtue of the push switch SW3, which serves also as the first urging means, (specifically, the resilient force of the return spring of the contact mechanism installed in the switch body 33), the operating knob N is urged and retained at the non-operated position N0 in the direction of swing around the first axis L1, and by virtue of the first and second toggle switches SW1 and SW2, which serve also as the second urging means, (specifically, the resilient force of the return spring of the contact mechanism installed in the switch bodies 31 and 32), the operating knob N is urged and retained at the non-operated position N0 in the direction of swing around the second axis L2. This eliminates the necessity for specially providing first and second urging means exclusively used therefor, and the structure of the switch device A can be made small and simplified accordingly.

In the assembled switch device A, when the operating knob N is pushed in from the non-operated position N0 toward the deeper side, that is, toward the push operation position N3 side (that is, carrying out the push operation), the operating knob N swings around the first axis L1 to thus engage with the push switch SW3, thereby exhibiting the push switch function of turning the switch SW3 ON. On the other hand, when the operating knob N is pressed and tilted from the non-operated position N0 toward the predetermined first or second toggle operation position N1 or N2 (that is, carrying out the first or second toggle operation), the operating knob N swings around the second axis L2 to thus engage with the first or second toggle switch SW1 or SW2, thereby exhibiting the toggle switch function of turning the switches SW1 and SW2 ON.

In particular, in the present embodiment, the engagement portion a3 where the operating knob N engages with the push switch SW3 at the time of a push operation (that is, the engagement portion where the push switch pressing projection 63 engages with the operating element 43 of the push switch SW3) is disposed on the second axis L2. Because of this, when the operating knob N swings around the second axis L2 at the time of a toggle operation, the swing displacement does not become an operating displacement (stroke) on the push switch SW3, and there is therefore no possibility that the push switch SW3 will be turned ON by the operating knob N.

Moreover, the engagement portions a1 and a2 where the operating knob N engages with the first and second toggle switches SW1 and SW2 at the time of the first and second toggle operations (that is, the engagement portions where the toggle switch pressing projections 61 and 62 engage with the operating elements 41 and 42 of the first and second toggle switches SW1 and SW2) are disposed at a position closer to the first axis L1 in the direction along the second axis L2 than the engagement portion a3 where the operating knob N engages with the push switch SW3. In this way, since a considerable difference is set between the distances of the former engagement portions a1 and a2 and the latter engagement portion a3 from the first axis L1 (that is, the swing fulcrum of the operating knob N), when the operating knob N swings around the first axis L1 at the time of a push operation, the push switch SW3 far away from the first axis L1 is reliably turned ON with a sufficient push-in stroke of the operating knob N, and on the other hand there is no possibility that the first and second toggle switches SW1 and SW2 close to the first axis L1 will be turned ON since the push-in stroke of the operating knob N for these switches is relatively short.

In this way, in the present embodiment since both the toggle operation and the push operation can be carried out reliably with the single operating knob N without erroneous operation, it is not necessary to greatly change the specifications (e.g. the operating stroke or the operating load) of the push switch SW3 and the toggle switches SW1 and SW2 in order to prevent erroneous operation, and this is remarkably advantageous in terms of simplification of the management of components and the assembly workability. Moreover, since the operating knob N for the toggle operation and the push operation is made as a single component, the number of components of the switch device A can be cut, the structure can consequently be made small and simplified, and it can be disposed in a confined space such as a vehicle body space without problems.

Furthermore, in the present embodiment, the first and second stopper means ST1 and ST2 are provided between the switch case 10 and the operating knob N, the first and second stopper means ST1 and ST2 restricting the swing displacement of the operating knob N when both the first or second toggle operation and the push operation on the operating knob N are erroneously carried out, so that from halfway through only either one of the operations can be carried out.

Figure 5:
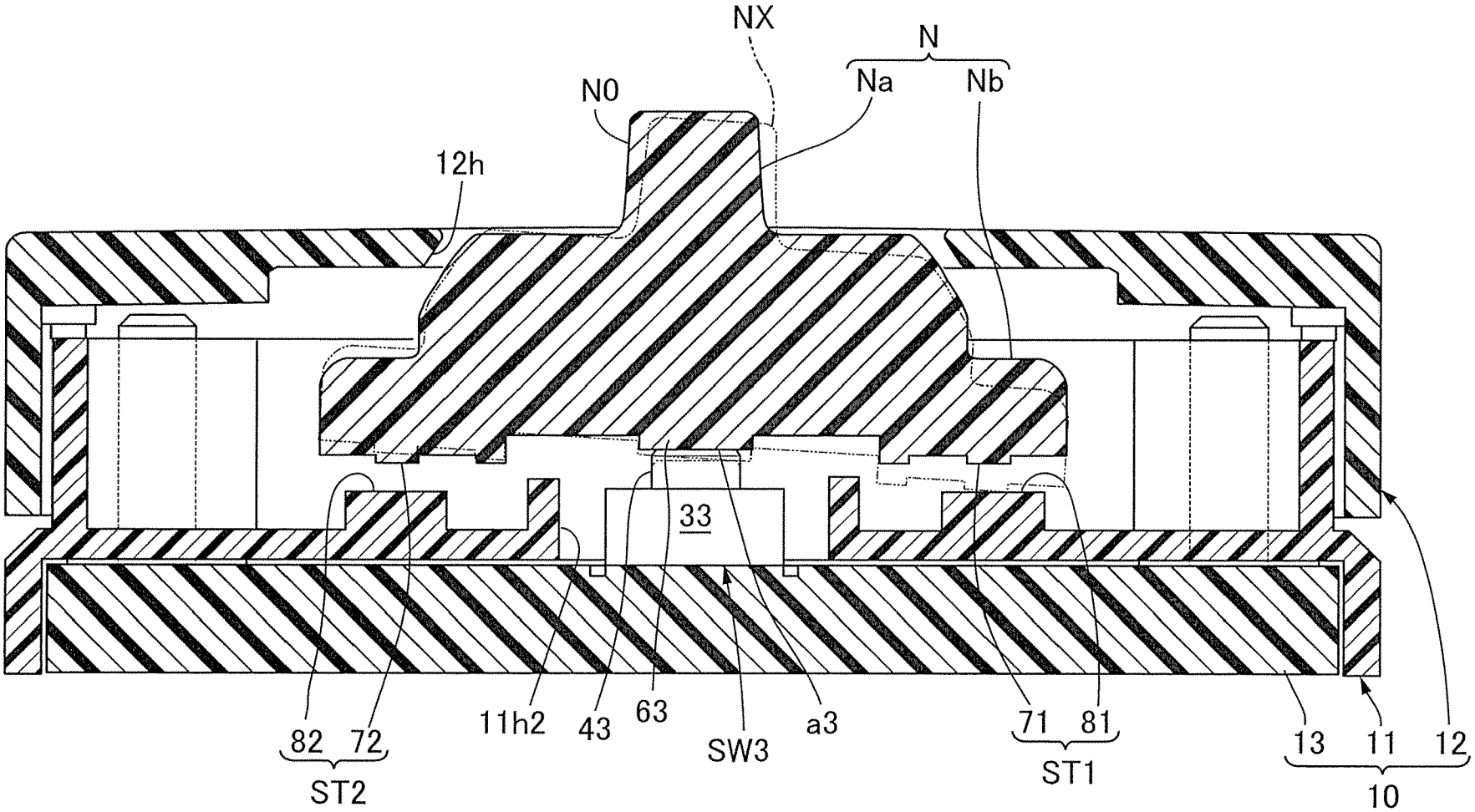
FIG. 5 is a sectional view along line 5-5 in FIG. 2.

For example, due to the first stopper means ST1 being specially provided, if both of the first toggle operation and the push operation are erroneously carried out on the operating knob N, as illustrated by the double-dotted broken line in FIG. 5, in a stage partway through the operation before the first toggle switch SW1 and the push switch SW3 are turned ON (see position NX of the operating knob N in this stage), the first projection 71 engages with the first fulcrum projection 81, and thereafter the first fulcrum projection 81 becomes a fulcrum and the operating knob N can carry out only either of the first toggle operation or the push operation. This is effective in preventing an erroneous operation of the switches in which both the first toggle switch SW1 and the push switch SW3 are turned ON.

When only one of the first toggle operation and the push operation is correctly carried out on the operating knob N, at least in a stage partway through the operation (in the present embodiment also in the final stage of the operation in which the switch SW1 or SW3 corresponding to the operation turns ON) the first projection 71 does not engage with the first fulcrum projection 81 and, therefore, there is no possibility that the first stopper means ST1 will become an obstacle to a legitimate first toggle operation or push operation.

Moreover, due to the second stopper means ST2 being specially provided, if both the second toggle operation and the push operation are erroneously carried out on the operating knob N, in a stage partway through the operation prior to the second toggle switch SW2 and the push switch SW3 being turned ON, the second projection 72 engages with the second fulcrum projection 82, and thereafter the second fulcrum projection 82 becomes a fulcrum and the operating knob N can carry out only either the second toggle operation or the push operation. This is effective in preventing an erroneous operation of the switches in which both the second toggle switch SW2 and the push switch SW3 are turned ON.

A position NX' of the operating knob N when both the second toggle operation and the push operation are erroneously carried out on the operating knob N is not shown in FIG. 5, but the position NX' and the position NX are in a line-symmetric positional relationship with respect to a vertical line passing through the second axis L2 as an axis of symmetry, the position NX being shown by the double-dotted broken line in FIG. 5 when both the first toggle operation and the push operation are erroneously carried out.

Furthermore, when only one of the second toggle operation and the push operation is correctly carried out on the operating knob N, at least in a stage partway through the operation (in the present embodiment also in the final stage of the operation in which the switch SW2 or SW3 corresponding to the operation turns ON) the second projection 72 does not engage with the second fulcrum projection 82 and, therefore, there is no possibility that the second stopper means ST2 will become an obstacle to a legitimate second toggle operation or push operation.

Moreover, in the present embodiment, the main shaft part 21 extending on the second axis L2 is provided on one side part of the operating knob N, the spherical surface portion 21*a* with the intersection point O between the first and second axes L1 and L2 as the center is provided on the main shaft part 21, and the support face 11*a* is provided on the switch case 10, the support face 11*a* being a spherical surface support part relatively slidably abutting against the spherical surface portion 21*a* so as to allow pivoting of the spherical surface portion 21*a* around each of the first and second axes L1 and L2. The main shaft part guide means Gm is provided between the main shaft part 21 and the switch case 10, the main shaft part guide means Gm guiding pivoting of the main shaft part 21 around each of the first and second axes L1 and L2 in cooperation with the support face 11*a* while fixing the intersection point O at the fixed position within the switch case 10. This enables the main shaft part 21 to be integrated with the operating knob N, the number of components to be reduced, the swing support structure of the operating knob N to be simplified and, consequently, cost to be saved.

Moreover, the countershaft part 22 extending on the second axis L2 is provided on the other side part of the operating knob N, and the countershaft part guide means Gs is provided between the countershaft part 22 and the switch case 10, the countershaft part guide means Gs guiding pivoting of the countershaft part 22 around the first axis L1 while allowing pivoting around the second axis L2. Because of this, even if the operating knob N is cantilever-supported on the case main body 11 on one side part (that is, the main shaft part 21) side, swinging around the first axis L1 of the free end part (the other side part) side of the operating knob N can be stably and appropriately guided by the countershaft part guide means Gs, the burden on the main shaft part 21 and the cantilever-support part (e.g. the first guide wall W1) of the switch case 10 supporting the operating knob N can be lightened, and this is advantageous in terms of improving the durability of the switch device A.

An embodiment of the present invention is explained above, but the present invention is not limited to the above embodiment and may be modified in a variety of ways as long as the modifications do not depart from the gist of the present invention.

For example, in the embodiment the switch device A of the present invention is provided on an instrument panel of an automobile, but the location of the switch device A is not limited to that in the embodiment; it may be installed at an appropriate place within an automobile compartment (e.g. a steering column, a steering, a car navigation operating part, a door inner face, etc.) and, alternatively, it may be installed at an appropriate place of a vehicle other than an automobile, for example, a two-wheeled motor vehicle (e.g. a handlebar cover, etc.). It may be installed in various types of machine and device other than a vehicle.

Moreover, in the embodiment, the switch device A is illustrated in which the operating knob N is made to swing around the second axis L2 between the non-operated position N0 and the first toggle operation position N1 and between the non-operated position N0 and the second toggle operation position N2 so as to enable a toggle operation in two mutually opposite directions (that is, having the first and second toggle operation positions N1 and N2 on opposite sides of the non-operated position N0), but the switch device A of the present invention is not limited to that of the embodiment. For example, the present invention can be applied to a switch device that does not have a second toggle operation position and carries out a toggle operation only between a single toggle operation position and a non-operated position.

Furthermore, in the embodiment, in the switch device A the operating knob N is pushed in from the non-operated position N0 (that is, carrying out a push operation) to thus turn ON the push switch SW3 and the operating knob N is pressed and tilted from the non-operated position N0 toward the first or second toggle operation position N1 or N2 (that is, a toggle operation) to thus turn ON the first or second toggle switch SW1 or SW2, but in the present invention when the operating knob N is subjected to a push operation the push switch SW3 may be turned OFF, and when it is subjected to a toggle operation the first or second toggle switch SW1 or SW2 may be turned OFF.

Moreover, in the embodiment, as the operating knob mounting structure via which the operating knob N is mounted on the switch case 10 so that it can swing around either of the first and second axes L1 and L2, the main shaft part 21 and the countershaft part 22 are integrated with the operating knob N, and the main shaft part 21 and countershaft part 22 are relatively swingably linked to the switch case 10. However, the mounting structure of the operating knob N is not limited to that of the embodiment, and the mounting structure may be such that at least the operating knob N can swing and be displaced around the first and second axes L1 and L2, which bisect each other at right angles at a fixed point (intersection point O) within the switch case 10. For example, the structure may be such that a substantially T-shaped shaft member (not illustrated) having a second shaft part with the second axis L2 as a central axis and a first shaft part that is integrally connected to one end part of the second shaft part and has the first axis L1 as a central axis is produced as a component separately and independently from the operating knob N, and the operating knob N is swingably supported on the switch case 10 via the shaft member (more specifically, a structure in which the first shaft part is pivotably linked to the switch case 10 so as to be relatively pivotable around the first axis L1, and the second shaft part is pivotably linked to the operating knob N so as to be relatively pivotable around the second axis L2).

Furthermore, in the embodiment, only one operating knob N of the present invention is provided on the switch case 10 as an operating knob, but in the present invention a plurality of operating knobs N of the present invention may be provided on the switch case 10 and, alternatively, an operating knob having another switch function (e.g. an operating knob exclusively used for a push operation, an operating knob exclusively used for a toggle operation, etc.) may be provided in combination.

What is claimed is:

1. A switch device comprising a switch case, an operating knob that is swingably mounted on the switch case, and urging devices that can urge and retain the operating knob at a predetermined non-operated position when the operating knob is not operated, the operating knob being capable of being pushed so as to swing around a first axis from the non-operated position to a predetermined push operation position with respect to the switch case and being capable of being toggled so as to swing around a second axis that is orthogonal to the first axis from the non-operated position to a predetermined toggle operation position, the switch case being provided with a push switch, as one of said urging devices, that engages with the operating knob and is switched ON or OFF when the operating knob attains the push operation position, and a toggle switch, as another of said urging devices, that engages with the operating knob and is switched ON or OFF when the operating knob attains the toggle operation position, a first engagement portion where the operating knob engages with the push switch being disposed on the second axis, and a second engagement portion where the operating knob engages with the toggle switch being disposed at a position closer to the first axis in a direction along the second axis than the first engagement portion where the operating knob engages with the push switch, wherein a main shaft part extending on the second axis is provided on one of opposite side parts of the operating knob.

2. The switch device according to claim 1, wherein a stopper device is provided between the switch case and the operating knob, the stopper device restricting swing displacement of the operating knob when both the toggle operation and the push operation are erroneously carried out for the operating knob, so that only either one of the operations can be carried out from halfway through the operation.

3. The switch device according to claim 1, wherein the main shaft part is provided with a spherical surface portion having an intersection point of the first and second axes as a center, the switch case is provided with a spherical surface support portion that relatively slidably abuts against the spherical surface portion to allow pivoting of the spherical surface portion around each of the first and second axes, and a main shaft part guide device is provided between the main shaft part and the switch case, the main shaft part guide device guiding pivoting of the main shaft part around each of the first and second axes while fixing the intersection point to a fixed position within the switch case in cooperation with the spherical surface support portion.

4. The switch device according to claim 3, wherein a countershaft part extending on the second axis is provided on an other of the opposite side parts of the operating knob, and a countershaft part guide device is provided between the countershaft part and the switch case, the countershaft part guide device guiding pivoting of the countershaft part around the first axis while allowing pivoting around the second axis.

5. The switch device according to claim 1, wherein the urging devices comprise a first urging device that can urge and retain the operating knob at the non-operated position in a swing direction around the first axis and a second urging device that can urge and retain the operating knob at the non-operated position in a swing direction around the second axis, the push switch serving also as the first urging device, and the toggle switch serving also as the second urging device.

6. The switch device according to claim 1, wherein the operating knob can be subjected to a toggle operation in two directions that are opposite to each other by swinging around the second axis between the non-operated position and the first toggle operation position and between the non-operated position and the second toggle operation position, and the toggle switch comprises a first toggle switch that is provided on one of opposite sides of the switch case with respect to the second axis and that engages with the operating knob and switches to ON or OFF when the operating knob attains the first toggle operation position, and a second toggle switch that is provided on an other of the opposite sides of the switch case with respect to the second axis and that engages with the operating knob and switches to ON or OFF when the operating knob attains the second toggle operation position.

7. The switch device according to claim 2, wherein the main shaft part is provided with a spherical surface portion having an intersection point of the first and second axes as a center, the switch case is provided with a spherical surface support portion that relatively slidably abuts against the spherical surface portion to allow pivoting of the spherical surface portion around each of the first and second axes, and a main shaft part guide device is provided between the main shaft part and the switch case, the main shaft part guide device guiding pivoting of the main shaft part around each of the first and second axes while fixing the intersection point to a fixed position within the switch case in cooperation with the spherical surface support portion.

8. The switch device according to claim 7, wherein a countershaft part extending on the second axis is provided on an other of the opposite side parts of the operating knob, and a countershaft part guide device is provided between the countershaft part and the switch case, the countershaft part guide device guiding pivoting of the countershaft part around the first axis while allowing pivoting around the second axis.

* * * * *